United States Patent [19]

Erni et al.

[11] Patent Number: 5,016,322

[45] Date of Patent: May 21, 1991

[54] FUNNEL ARRANGEMENT AT THE OUTLET OF A CARD MACHINE

[75] Inventors: Daniel Erni, Frauenfeld; Paul Staeheli, Wilen, both of Switzerland

[73] Assignee: Maschinenfabrik Rieter AG, Winterthur, Switzerland

[21] Appl. No.: 439,415

[22] Filed: Nov. 21, 1989

[30] Foreign Application Priority Data

Nov. 22, 1988 [DE] Fed. Rep. of Germany ..... 3839413

[51] Int. Cl.[5] ..... D01G 15/46

[52] U.S. Cl. ..... 19/150

[58] Field of Search ..... 19/150

[56] References Cited

U.S. PATENT DOCUMENTS

| | | | |
|---|---|---|---|
| 984,195 | 2/1911 | Cooper | 19/150 |
| 1,554,255 | 9/1925 | Aubourg | 19/150 |
| 3,246,370 | 4/1966 | West | 19/150 |
| 3,814,660 | 6/1974 | Naegeli | 19/150 |
| 4,475,272 | 10/1984 | Wood | 19/150 |
| 4,630,336 | 12/1986 | Schöpwinkel et al. | 19/150 |

FOREIGN PATENT DOCUMENTS

| | | | |
|---|---|---|---|
| 586167 | 4/1925 | France | 19/150 |
| 73267 | 5/1970 | German Democratic Rep. | 19/150 |
| 531578 | 1/1973 | Switzerland | 19/150 |
| 524887 | 8/1940 | United Kingdom | 19/150 |

*Primary Examiner*—Werner H. Schroeder
*Assistant Examiner*—John J. Calvert
*Attorney, Agent, or Firm*—Burns, Doane, Swecker & Mathis

[57] ABSTRACT

A funnel arrangement adapted for use at the outlet of a card machine or drawing frame for the purpose of bringing together a sliver traveling along a feed path. The funnel arrangement includes a funnel and an air squeeze-out device following the funnel for squeezing air out of the sliver. The funnel arrangement is located upstream of a downstream funnel used for introducing the sliver into a calender roll pair. A housing surrounds the air squeeze-out device and forms an air discharge chamber which extends at least substantially from the upstream funnel to the downstream funnel. The air squeeze-out device includes openings which allow air to pass into the air discharge chamber, the openings being formed by gaps between convolutions of a frusto-conically shaped coil of wire or by gaps between a plurality of spaced-apart converging rods arranged in a frusto-conically shaped pattern. The funnel arrangement can be mounted so as to be movable away from a calender roll pair or the funnel arrangement can be arranged in two parts which are separable from each other in a direction along the length of the feed path for ease of threading the sliver through the funnel arrangement when the two parts are separated from each other. The two part arrangement could be such that only the upstream funnel and the air squeeze-out device form a unit which can be separated into two parts.

26 Claims, 3 Drawing Sheets

FUNNEL ARRANGEMENT AT THE OUTLET OF A CARD MACHINE

FIELD OF THE INVENTION

The present invention relates to a funnel arrangement at the outlet of a card machine or drawing frame for bringing together a sliver. The funnel arrangement includes a funnel which precedes a calender roll pair which can be constructed, in particular, as a stepped roll pair and which at its tapered outlet end is provided with a nozzle opening which is preferably substantially rectangular in cross-section.

BACKGROUND

A funnel arrangement is usually employed at the outlet or delivery end of a card machine to bring together or press together a sliver which is delivered by the card machine. The sliver comprises a relatively loose air-including structure which is compressed with simultaneous pressing out of the included air by the funnel arrangement so that the already precompressed fiber band or sliver can be supplied to the nip of the following calender roll pair. Usually, the calender roll pair is a stepped roll pair which detects deviations of the sliver count and the output signal of which can be used to control the card machine.

As in all other areas of yarn manufacture, the aim is to increase the production rate of the card machine and this has also been achieved to a large extent. However, at these high production rates, a problem is encountered in that a sliver moving at high speed contains a relatively large amount of air which is squeezed out of the sliver in the funnel. However, the squeezing out of the air at high sliver speeds results in a spreading of the sliver which occurs directly in front of the funnel. Such spreading of the sliver can be to such an extent that the sliver expands balloon-like beyond the edges of the inlet end of the funnel and this can lead to damaging the fibers, to yarn faults and possibly to an interruption in the sliver. Furthermore, the initial introduction of the sliver through the nozzle opening of the funnel requires a certain amount of skill.

SUMMARY OF THE INVENTION

Preferred arrangements in accordance with the invention can in use serve to counteract the ballooning effect without substantially increasing the difficulty of introducing the sliver through a nozzle opening of the above-mentioned funnel for introducing the sliver into a nip region of a calender roll pair. Such arrangements can also serve to simplify as much as possible the introduction of the sliver into the funnel opening.

According to the invention, a funnel arrangement is provided which includes an upstream funnel and an air squeeze-out means which is connected after the upstream funnel, the funnel arrangement being adapted to be connected in front of a downstream funnel for introducing the sliver into a nip region of a calender roll pair. The air squeeze-out means continues the tapering of the upstream funnel which extends in the direction of movement of the sliver and includes lateral openings. A housing can be provided which surrounds the air squeeze-out means, forms an air discharge chamber and extends at least substantially from the upstream funnel to the downstream funnel.

The upstream funnel performs a guiding function and assists the movement of the sliver into the air squeeze-out means. The tapered form of the air squeeze-out means results in an increasing or progressive compacting of the sliver and a pressing out of the air included therein which is able to escape out of the lateral openings of the air squeeze-out means into the housing. On leaving the air squeeze-out means, the sliver already has a reduced cross-section compared with slivers which do not pass through such an upstream funnel and air squeeze-out means prior to passing through the downstream funnel. This therefore considerably facilitates both the entering of the sliver into the downstream funnel and the escaping of air included in the sliver.

To remove expelled air, the housing can be connected to a vacuum source, for which purpose the housing preferably has an air discharge connection tube piece, which allows the expelled air to be easily removed. The suction power of the suction source or the partial vacuum, however, must not be so high that fibers are pulled out of the relatively loose sliver.

A unit comprising the upstream funnel, the air squeeze-out means and the downstream funnel can be attached in front of the calender roll pair in a manner such that it can be moved out of the way. In particular, the unit could be pivotally mounted so as to be rotatable downwardly and at least easily removed. Such an arrangement could serve to facilitate necessary cleaning of the unit or the region in front of the calender roll pair.

According to a particularly preferred embodiment, the air squeeze-out means comprises a wire spiral having a substantially conical outer shape, at least some of the wire convolutions being spaced a distance apart. The lateral openings of the air squeeze-out means are formed by the spacings between the wire convolutions. The use of such a wire spiral also has an advantage in that the air squeeze-out means can be made economically and without sharp edges. By avoiding sharp edges, the danger of clogging of the funnel arrangement, in particular in the region of the air squeeze-out means, can be substantially reduced.

According to a further preferred embodiment, the air squeeze-out means can have the form of a conical cage. The cage preferably comprises a plurality of rods directed in the direction of movement of the sliver, at least some of the adjacent rods being spaced a distance apart. The rods can be arranged at regular distances apart to form the cage, without an end ring at the outlet end of the cage.

The cage rods may have a round, oval or rectangular cross-section and are preferably formed of spring steel. With this construction, the rods can easily be mounted in a ring at the inlet end of the air squeeze-out means and the ring can be formed in an advantageous manner by the upstream funnel itself. The exact nature of the mounting can be selected as desired, for example, threads may be formed at one end of the rods or the rods can be secured in the ring by a suitable connection such as by clamping or by welding, hard soldering, soldering or adhering. This construction also permits the funnel arrangement to be divided, that is, the upstream funnel and the cage of the air squeeze-out means and preferably also the housing and possibly also the downstream funnel can be divided in a longitudinal plane containing the direction of movement of the sliver.

In this construction, for example, one half of the divided funnel arrangement can be articulately mounted on the other half. Thus, one half of the funnel arrangement could be removed or pivoted away from the other half for purposes of permitting introduction of the sliver or elimination of any clogging which might occur.

The air squeeze-out means may also have a cross-section which is at least substantially oval, elliptical or approximately rectangular, at least at its end facing the downstream funnel.

With this construction, the cross-sectional form of the sliver entering the nozzle of the downstream funnel can be predefined by the air squeeze-out means itself and this favorably influences the introduction of the sliver into the nozzle opening of the downstream funnel.

In the funnel arrangement according to the invention, it is possible to make the downstream funnel shortened compared with conventional funnels but with substantially the same tapering. For example, the downstream funnel can have an axial length from the inlet end thereof to the inlet end of the nozzle opening of less than three centimeters. In other words, the downstream funnel can be converted to a "residual funnel" of which the smaller axial length facilitates threading in of the sliver.

Furthermore, it is even possible for the downstream funnel to be formed by the calender roll pair itself.

According to a further embodiment of the invention, the outlet end of the air squeeze-out means can lie in front of or directly in front of the inlet end of the downstream funnel. With this construction, on removal or pivoting away of one half of the funnel arrangement, it is possible to only remove one half of the upstream funnel, the air squeeze-out means and possibly the housing. The introduction of the sliver into the downstream funnel is nevertheless positively influenced by this shortened construction.

In a particularly practical construction of the funnel arrangement according to the invention, the inner face of the downstream funnel has a cone angle of 60° to 90°, preferably about 75°, and the cone angle of the upstream funnel and of the air squeeze-out means lies in the range of between 30° to 60° and is preferably 45°.

BRIEF DESCRIPTION OF THE DRAWINGS

The invention will be explained in detail hereinafter with reference to the drawings, wherein:

FIG. 1A shows a modification of the arrangement shown in FIG. 1;

DETAILED DESCRIPTION OF THE PREFERRED EMBODIMENTS

Figure 1:
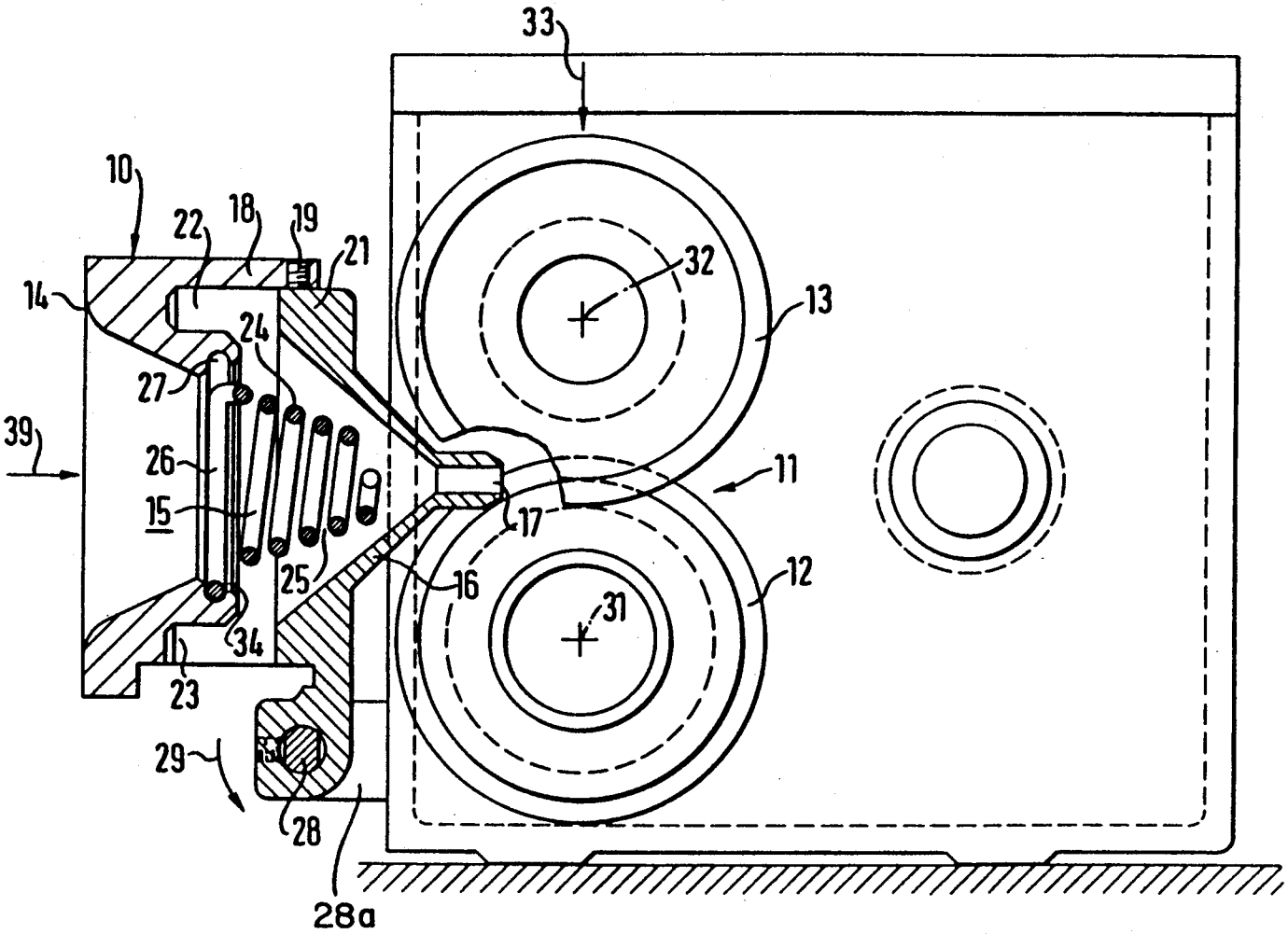
FIG. 1 shows a partially sectioned side elevation of one preferred embodiment of the funnel arrangement according to the invention which includes an upstream funnel and an air squeeze-out means adapted to be connected in front of a downstream funnel.

FIG. 1 shows a funnel arrangement 10 disposed in front of a stepped roll pair 11 comprising two stepped rolls 12 and 13. The funnel arrangement 10 includes an upstream funnel 14 located upstream along a path of movement 39 of a sliver and an air squeeze-out means 15 adapted to be mounted upstream of a downstream funnel 16, the downstream funnel 16 having a nozzle opening 17 which projects into a nip region of the stepped roll pair 11. The upstream funnel 14 has an outer cylindrical jacket part 18 which is mounted via three clamping screws 19 (of which only one clamping screw is shown) on a flange part 21 of the downstream funnel 16. The cylindrical jacket part 18 thus surrounds the air squeeze-out means 15 and forms a chamber 22 which can be connected by means of an air connection 23 to a suction or partial vacuum source. The air squeeze-out means 15 is formed in this example as a wire funnel which continues the conical shape of the upstream funnel 14.

The wire funnel 15 can be constructed as a conical wire spiral from a single round wire, preferably spring steel, the individual convolutions 24 of the wire spiral being spaced distances 25 from each other which form lateral openings. A convolution 26 of the wire spiral with the greatest diameter is seated in a correspondingly formed annular groove 27 in the upstream funnel 14 and is fixedly held therein due to the spring properties of the wire spiral. The resilient properties of the wire spiral also facilitate insertion of the convolution 26 into the groove 27. For this purpose, the diameter of the convolution 26 may first be reduced by applying corresponding forces and then brought into the region of the groove 27. After removing the forces serving to reduce the diameter of the convolution 26, the latter expands again until it is held in a form-locking and frictionally locking manner in the groove 27.

Alternatively, the groove 27 may be formed in the shape of a thread (not shown) so that the wire spiral of the convolution 26 can be rotated into such a thread.

Because the convolutions 24 of the wire spiral are formed from round wire, no sharp edges are formed on the air squeeze-out means 15 which could lead to catching of the fibers.

In another embodiment of the invention, the upstream funnel, the air squeeze-out means 15 and the downstream funnel 16 form a unit which can be moved away from the roll pair 11 by suitable means **28*a* and the unit can then be pivoted away from the roll pair 11 by means of a joint 28 such as by pivoting the unit in the direction of the arrow 29 to permit cleaning of the region in front of the stepped roll pair 11**.

The nozzle opening 17 preferably has a rectangular cross-section of which the longer axis in FIG. 1 extends in a vertical direction. The sliver emerging from the opening 17 can then be pressed flat in the horizontal direction by the stepped roll pair 11, the sliver passing through a rectangular opening between the stepped rolls of which the longer axis extends in a horizontal direction. In a conventional manner, the lower stepped roll 12 is arranged rotatably about a stationary axis 31 and the upper stepped roll 13 is arranged rotatably about an axis 32 which is pressed resiliently by a biasing force in the direction of an arrow 33 against the lower stepped roll 12. Depending on the sliver count, the position of the stepped roll 13 changes under the biasing force in the direction of the arrow 33, the particular position representing a measure of the sliver count. This position can be determined and information regarding the position can be used for control of the card machine.

In operation, the end of the sliver coming from the card in longitudinal revolution is twisted between the hands of an operator to a point and pushed through an outlet end 34 of the upstream funnel 14 until the tip pokes through the rectangular opening 17 and is entrained by the stepped rolls, the lower roll 12 of which is driven. Thereafter, the card machine can be switched to operating velocity. The air contained in the sliver is squeezed out of the latter by the air squeeze-out means 15 during passage through the funnel arrangement and excess air is then removed from the chamber 22 via the connection 23. During this operation, the upstream funnel 14 has a guide function and the wire funnel 15 has a squeezing and air removal function. The downstream funnel 16 brings the sliver together.

With card slivers of different size or staple length or different air content, it may be expedient to change the axial spacing between the upstream funnel 14 and the downstream funnel 16. This can easily be done according to the invention in that the cylinder part 18 of the upstream funnel 14 can include a relatively coarse thread (see FIG. 1A) at its end facing the downstream funnel 16, the thread cooperating with a corresponding thread on the downstream funnel 16 so that by turning the upstream funnel 14, cooperation between the two threads leads to a change in the axial spacing between the downstream funnel and the upstream funnel.

Figure 2:
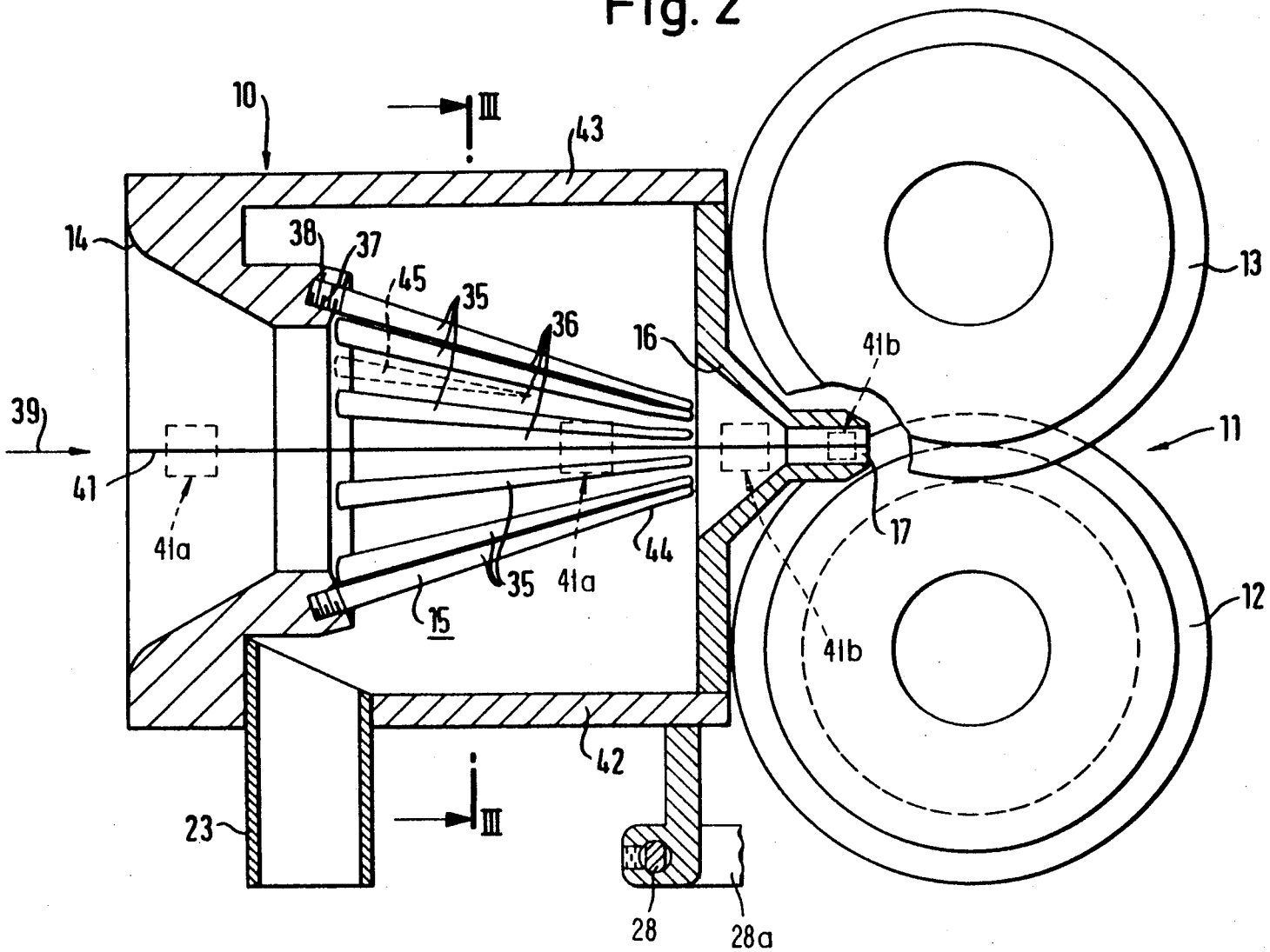
FIG. 2 shows a side elevation of another preferred embodiment of the invention.

A further embodiment can be seen in FIG. 2. In this embodiment, parts corresponding to parts of FIG. 1 are provided with the same reference numerals. In contrast to the construction of FIG. 1, the air squeeze-out means 15 in this embodiment is formed by a plurality of single rods 35 which are provided in a frusto-conical arrangement with one end thereof having threads 37 which are screwed into corresponding bores of the upstream funnel 14, the bores being provided with internal threads 38. In this embodiment, spacings 36 are provided between the individual rods 35 which form lateral openings of the air squeeze-out means 15. This construction has a particular advantage in that the funnel arrangement can be divided along a symmetry plane 41 into two halves 42, 43, the lower half 42 being, for example, fixedly attached to the card frame but the upper half 43 being arranged so that it can be removed or pivoted by suitable means 41*a*, 41*b* away from the lower half 42. By pivoting away one half of the funnel arrangement, the sliver can be introduced particularly easily into the funnel arrangement.

FIG. 2 also shows that the downstream funnel 16 may be given a shortened construction and this also facilitates introduction of the sliver into the downstream funnel 16. For example, the downstream funnel can have an axial length from the inlet end thereof to the inlet end of the nozzle opening of less than three centimeters. This shortened construction could also be employed in the embodiment according to FIG. 1. In the embodiment according to FIG. 2, the ends of the rods 35 facing the downstream funnel 16 are so arranged that they stop just before the downstream funnel 16. The ends of the rods may be bent at 44 slightly radially outwardly with respect to the path of sliver movement 39, as shown in FIG. 2, so that the sliver runs off gently. It can also be seen that the rods 35 have a slightly tapered form so that even at the end facing the downstream funnel 16, adequate intermediate space 36 is still present between the adjacent rods. Should the intermediate spaces at the inlet end of the air squeeze-out means 15 be too wide, involving a risk of inadequate guiding of the sliver, shortened rods 45 (shown in dashed lines) can be interposed between adjacent ones of the rods 35. With such an arrangement, it would be possible to exclude the downstream funnel 16 from the separable funnel arrangement, that is, the separable two halves of the funnel arrangement could be limited to the upstream funnel 14 and the air squeeze-out means 15, no division of the downstream funnel 16 thus being necessary. This then has the particular advantage that on opening the funnel arrangement, it would not be necessary to first remove the downstream funnel 16 from the stepped roll pair 11 in a direction opposite to the sliver running direction 39.

Figure 3:
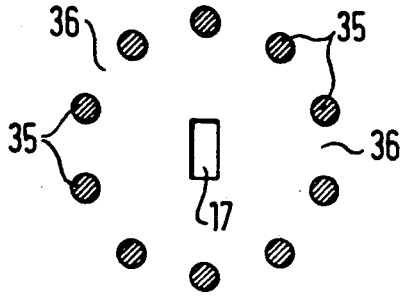
FIG. 3 shows a cross-section along the sectional plane III—III of FIG. 2.

FIG. 3 shows that the rods 35 can be arranged in a pattern which is circular in cross-section and which forms a circular cone.

Figure 4:
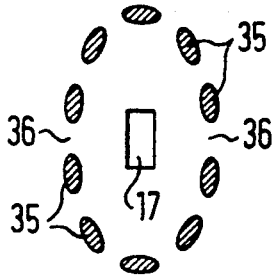
FIG. 4 shows a cross-section corresponding to the cross-section of FIG. 3 but of another embodiment.

FIG. 4 shows a further modification of the air squeeze-out means of FIG. 3 in which the individual rods 35 have an oval cross-section and are arranged in a pattern which is elliptical in cross-section. In this case, the arrangement of the rods in the overall elliptical cross-sectional pattern provides the air squeeze-out means.

This cross-section helps adapt the sliver to adopt the desired rectangular cross-section the sliver must take when it is led through the rectangular opening 17 of the downstream funnel 16.

Figure 5:
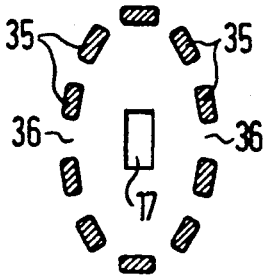
FIG. 5 shows a cross-section corresponding to FIG. 4 but of a further embodiment.

FIG. 5 shows a further possible cross-sectional form for the rods of the air squeeze-out means 15. In this case, the individual rods 35 have a rectangular cross-sectional shape and the edges or corners of the rectangular shaped rods 35 are preferably slightly rounded to avoid catching fibers. As in the arrangement shown in FIG. 4, the pattern of the rods shown in FIG. 5 can have an elliptical cross-section.

Figure 6:
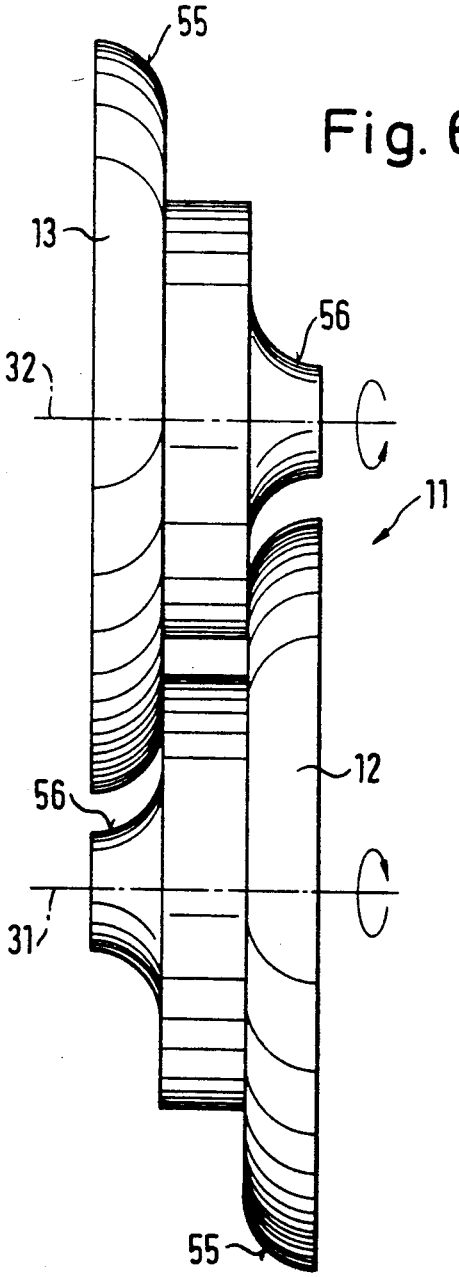
FIG. 6 shows a side elevation of a calender roll pair according to the invention which is so constructed that it performs the function of the downstream funnel.

Finally, FIG. 6 shows a side elevation of the stepped roll pair 11 wherein the rolls 13, 12 include rounded shoulder regions 55, 56, respectively, so that these shoulders themselves form a sort of funnel which can perform the function of the downstream funnel 16. In particular, the shoulder regions 55 form surfaces which converge toward the direction of movement of the sliver at least around the rectangular opening formed by the rolls and through which the sliver passes. Accordingly, in this case the particular form of the downstream funnel shown in FIGS. 1 and 2 can be replaced with the stepped roll pair 11 shown in FIG. 6.

While the invention has been described with reference to the foregoing embodiments, changes and modifications may be made thereto which fall within the scope of the appended claims.

What is claimed is:

1. A funnel arrangement for bringing together a sliver and adapted to be interposed between an outlet of a card machine or drawing frame and a nip region of a calender roll pair, the funnel arrangement including a tapered funnel and an air squeeze-out means for squeezing air out of the sliver, the air squeeze-out means being connected after said funnel, the air squeeze-out means providing continuation of the tapering of the funnel along a direction of movement of the sliver and including lateral openings for discharging air squeezed out of the sliver by the air squeeze-out means, the air squeeze-out means having a pair of opposed axial ends spaced apart in said direction of movement with at least one of said lateral openings extending continuously from one of the axial ends to the other one of the axial ends.

2. The funnel arrangement according to claim 1, further comprising a housing which surrounds the air squeeze-out means and forms an air discharge chamber which extends at least substantially from the funnel, the housing including an air discharge tube piece or connection for removal of air from the housing.

3. A funnel arrangement for bringing together a sliver and adapted to be interposed between an outlet of a card machine or drawing frame and a nip region of a calender roll pair, the funnel arrangement including a tapered funnel and an air squeeze-out means for squeezing air out of the sliver, the air squeeze-out means being connected after said funnel, the air squeeze-out means providing continuation of the tapering of the funnel along a direction of movement of the sliver and including lateral openings for discharging air squeezed out of the sliver by the air squeeze-out means, the air squeeze-out means including a wire spiral having convolutions thereof arranged in a substantially conical shape, at least some of the wire convolutions being spaced a distance apart.

4. The funnel arrangement according to claim 1, wherein the air squeeze-out means includes a conically shaped cage.

5. The funnel arrangement according to claim 4, wherein the cage includes rods having a rounded configuration and extending in the direction of movement of the sliver, at least some of the rods being spaced a distance apart.

6. The funnel arrangement according to claim 5, wherein at least one of the cage rods has a cross-section selected from the group consisting of round, oval and rectangular and the at least one opening becomes smaller in a direction away from the funnel.

7. The funnel arrangement according to claim 5, wherein at least one of the cage rods comprises a spring steel material.

8. The funnel arrangement according to claim 5, wherein at least one of the rods has a tapered cross-section which becomes smaller in a direction away from the funnel.

9. A funnel arrangement for bringing together a sliver and adapted to be interposed between an outlet of a card machine or drawing frame and a nip region of a calender roll pair, the funnel arrangement including a tapered funnel and an air squeeze-out means for squeezing air out of the sliver, the air squeeze-out means being connected after said funnel, the air squeeze-out means providing continuation of the tapering of the funnel along a direction of movement of the sliver and including lateral openings for discharging air squeezed out of the sliver by the air squeeze-out means, each of the funnel and the cage of the air squeeze-out means being divided in a longitudinal plane containing the direction of movement of the sliver, one half of the divided funnel arrangement being removably connected to the other half thereof.

10. The funnel arrangement according to claim 1, wherein the air squeeze-out means has a cross-sectional shape at least at an outlet end thereof which is selected from the group consisting of round, elliptical and rectangular.

11. A funnel arrangement for bringing together a sliver and adapted to be interposed between an outlet of a card machine or drawing frame and a nip region of a calender roll pair, the funnel arrangement including a tapered funnel and an air squeeze-out means for squeezing air out of the sliver, the air squeeze-out means being connected after said funnel, the air squeeze-out means providing continuation of the tapering of the funnel along a direction of movement of the sliver and including lateral openings for discharging air squeezed out of the sliver by the air squeeze-out means, the air squeeze-out means comprising a plurality of laterally spaced-apart rods which are arranged in a substantially conically shaped pattern with free ends of the rods converging toward each other in a direction away from the funnel, the free ends being bent radially outwardly with respect to the conically shaped pattern away from the direction of movement of the sliver.

12. The funnel arrangement according to claim 9, wherein one half of the divided funnel arrangement is pivotally connected to the other half thereof.

13. A funnel arrangement for bringing together a sliver and adapted to be interposed between an outlet of a card machine or drawing frame and a nip region of a calender roll pair, the funnel arrangement comprising a downstream funnel having a nozzle opening at a tapered outlet end thereof, a tapered upstream funnel and an air squeeze-out means for squeezing air out of the sliver, the air squeeze-out means being connected after the upstream funnel and in front of the downstream funnel, the air squeeze-out means providing continuation of the tapering of the upstream funnel along a direction of movement of the sliver and including lateral openings for discharging air squeezed out of the sliver by the air squeeze-out means, the air squeeze-out means having a pair of opposed axial ends spaced apart in said direction of movement with at least one of said lateral openings extending continuously from one of the axial ends to the other one of the axial ends.

14. A funnel arrangement for bringing together a sliver and adapted to be interposed between an outlet of a card machine or drawing frame and a nip region of a calender roll pair, the funnel arrangement comprising a downstream funnel having a nozzle opening at a tapered outlet end thereof, a tapered upstream funnel and an air squeeze-out means for squeezing air out of the sliver, the air squeeze-out means being connected after the upstream funnel and in front of the downstream funnel, the air squeeze-out means providing continuation of the tapering of the upstream funnel along a direction of movement of the sliver and including lateral openings for discharging air squeezed out of the sliver by the air squeeze-out means, a unit comprising the upstream funnel, the air squeeze-out means and the downstream funnel being attached in front of a calender roll pair in a manner such that is can be moved away from the calender roll pair.

15. The funnel arrangement according to claim 14, wherein the calender roll pair comprises a stepped roll pair, the stepped roll pair forming a rectangular shaped opening therebetween through which the sliver passes, the unit being pivotally mounted so as to be pivotal in a direction away from the calender roll pair.

16. A funnel arrangement for bringing together a sliver and adapted to be interposed between an outlet of a card machine or drawing frame and a nip region of a calender roll pair, the funnel arrangement comprising a downstream funnel having a nozzle opening at a tapered outlet end thereof, a tapered upstream funnel and an air squeeze-out means for squeezing air out of the sliver, the air squeeze-out means being connected after the upstream funnel and in front of the downstream funnel, the air squeeze-out means providing continuation of the tapering of the upstream funnel along a direction of movement of the sliver and including lateral openings for discharging air squeezed out of the sliver by the air squeeze-out means, the air squeeze-out means including a wire spiral having convolutions thereof arranged in a substantially conical shape, at least some of the wire convolutions being spaced a distance apart.

17. A funnel arrangement for bringing together a sliver and adapted to be interposed between an outlet of a card machine or drawing frame and a nip region of a calender roll pair, the funnel arrangement comprising a downstream funnel having a nozzle opening at a tapered outlet end thereof, a tapered upstream funnel and an air squeeze-out means for squeezing air out of the sliver, the air squeeze-out means being connected after the upstream funnel and in front of the downstream funnel, the air squeeze-out means providing continuation of the tapering of the upstream funnel along a direction of movement of the sliver and including lateral openings for discharging air squeezed out of the sliver by the air squeeze-out means, the air squeeze-out means including a conically shaped cage, the cage including rods which extend in the direction of movement of the sliver, at least some of the rods being spaced a distance apart.

18. The funnel arrangement according to claim 13, wherein the downstream funnel includes a short tapered bore having an inlet end and an outlet end thereof, the bore having an axial length from the inlet end of the bore to an inlet end of the nozzle of less than three centimeters.

19. The funnel arrangement according to claim 13, wherein an outlet end of the air squeeze-out means lies in front of an inlet end of the downstream funnel.

20. The funnel arrangement according to claim 13, wherein an inner face of the downstream funnel has a cone angle of 60° to 90° and a cone angle of inner surfaces of the upstream funnel and of the air squeeze-out means lies in the range between 30° and 60°.

21. A funnel arrangement for bringing together a sliver and adapted to be interposed between an outlet of a card machine or drawing frame and a nip region of a calender roll pair, the funnel arrangement comprising a downstream funnel having a nozzle opening at a tapered outlet end thereof, a tapered upstream funnel and an air squeeze-out means for squeezing air out of the sliver, the air squeeze-out means being connected after the upstream funnel and in front of the downstream funnel, the air squeeze-out means providing continuation of the tapering of the upstream funnel along a direction of movement of the sliver and including lateral openings for discharging air squeezed out of the sliver by the air squeeze-out means, and means for varying an axial spacing between the upstream funnel and the downstream funnel.

22. The funnel arrangement of claim 21, wherein said means for varying the axial spacing between the upstream funnel and the downstream funnel comprises a threaded connection between the downstream funnel and a housing which supports the upstream funnel.

23. The funnel arrangement of claim 13, wherein the downstream funnel comprises surfaces of a stepped roll pair which converge towards the direction of movement of the sliver.

24. A funnel arrangement for bringing together a sliver and adapted to be interposed between an outlet of a card machine or drawing frame and a nip region of a calender roll pair, the funnel arrangement comprising a downstream funnel having a nozzle opening at a tapered outlet end thereof, a tapered upstream funnel and an air squeeze-out means for squeezing air out of the sliver, the air squeeze-out means being connected after the upstream funnel and in front of the downstream funnel, the air squeeze-out means providing continuation of the tapering of the upstream funnel along a direction of movement of the sliver and including lateral openings for discharging air squeezed out of the sliver by the air squeeze-out means, the air squeeze-out means comprising a plurality of laterally spaced-apart rods which are arranged in a substantially conically shaped pattern with free ends of the rods converging toward each other in a direction away from the upstream funnel, the free ends being bent radially outwardly with respect to the conically shaped pattern away from the direction of movement of the sliver.

25. The funnel arrangement of claim 13, wherein the upstream funnel, the air squeeze out means and the downstream funnel are each divided in a longitudinal plane containing the direction of movement of the sliver, one half of the divided funnel arrangement being removably connected to the other half thereof.

26. The funnel arrangement of claim 25, wherein one half of the divided funnel arrangement is pivotally connected to the other half thereof.

* * * * *